US009334825B2

(12) United States Patent
Kojima

(10) Patent No.: US 9,334,825 B2
(45) Date of Patent: May 10, 2016

(54) FUEL SUPPLY APPARATUS FOR INTERNAL COMBUSTION ENGINE

(75) Inventor: Susumu Kojima, Susono (JP)

(73) Assignee: TOYOTA JIDOSHA KABUSHIKI KAISHA, Aichi-ken (JP)

( * ) Notice: Subject to any disclaimer, the term of this patent is extended or adjusted under 35 U.S.C. 154(b) by 262 days.

(21) Appl. No.: 14/233,543

(22) PCT Filed: Sep. 2, 2011

(86) PCT No.: PCT/JP2011/070037

§ 371 (c)(1),
(2), (4) Date: Jan. 17, 2014

(87) PCT Pub. No.: WO2013/031019

PCT Pub. Date: Mar. 7, 2013

(65) Prior Publication Data

US 2014/0163843 A1 Jun. 12, 2014

(51) Int. Cl.
*F02D 41/20* (2006.01)
*F02D 41/30* (2006.01)
(Continued)

(52) U.S. Cl.
CPC ..... *F02D 41/3094* (2013.01); *F02D 41/20* (2013.01); *F02D 41/22* (2013.01); *F02D 2041/2089* (2013.01); *F02M 65/00* (2013.01); *F02M 2200/21* (2013.01)

(58) Field of Classification Search
CPC ..... F02D 41/20; F02D 41/22; F02D 41/221; F02D 2041/2058; F02D 2041/2089; F02M 65/00; F02M 2200/21; F02M 51/005
USPC ..... 123/299–300, 478–494; 73/114.45
See application file for complete search history.

(56) References Cited

U.S. PATENT DOCUMENTS 4,246,566 A * 1/1981 Endo ..... B60T 8/885 344/450.2
4,972,293 A * 11/1990 Verner ..... F02D 41/2435 123/480

(Continued)

FOREIGN PATENT DOCUMENTS

JP 58-214634 A 12/1983
JP 62233473 A 10/1987

(Continued)

*Primary Examiner* — Thomas Moulis
(74) *Attorney, Agent, or Firm* — Suhrue Mion, PLLC

(57) ABSTRACT

A drive circuit (52) that is commonly provided with respect to two fuel injection valves (24R and 24L) for the same cylinder, and drive the two fuel injection valves (24R and 24L) for the same cylinder on the basis of a command from an ECU (40), is provided. An electric conduction line (52) that electric current supplied to the two fuel injection valves (24R and 24L) flows through, is provided. The electric conduction line (52) includes a common section (56*a*) one end of which is connected to the drive circuit (52), and branch sections (56*b*) which are sections following the other end of the common section (56*a*) that the electric conduction line (56) branches off at and on which the two fuel injection valves (24R and 24L) for the same cylinder are respectively installed. The electric current value I flowing through the common section (56*a*) is detected. An electric resistance (58) that is inserted in the branch section (56*b*) for the fuel injection valve (24L), is provided. A fuel injection valve, at which an occurrence of abnormality concerning electric conduction is recognized, out of the two fuel injection valves (24R and 24L) for the same cylinder, is detected on the basis of the magnitude of the electric current value I.

10 Claims, 5 Drawing Sheets

(51) Int. Cl.
*F02D 41/22* (2006.01)
*F02M 65/00* (2006.01)

(56) References Cited

U.S. PATENT DOCUMENTS 6,761,059 B2 * 7/2004 Hsia ..... F02M 65/00 73/114.45
7,168,413 B2 * 1/2007 Oono ..... F02D 41/20 123/479
7,252,072 B2 * 8/2007 Slater ..... F02D 41/20 123/479
7,253,539 B2 * 8/2007 Bolz ..... F02D 41/20 123/478
7,273,039 B2 * 9/2007 Ohno ..... F02D 41/22 123/479
7,497,204 B2 * 3/2009 Perryman ..... F02D 41/2096 123/479
7,856,867 B2 * 12/2010 Lucido ..... F02D 41/20 73/114.45
7,966,871 B2 * 6/2011 Perryman ..... F02D 41/2096 73/114.45
8,161,946 B2 * 4/2012 Pursifull ..... F02D 41/20 123/479
9,097,225 B2 * 8/2015 Qiao ..... F02M 51/00
2005/0126542 A1 6/2005 Oono
2006/0207564 A1 9/2006 Kinose
2007/0227506 A1 * 10/2007 Perryman ..... F02D 41/2096 123/479
2009/0216429 A1 8/2009 Yamashita et al.
2011/0125386 A1 5/2011 Pursifull

FOREIGN PATENT DOCUMENTS

JP 10-252539 A 9/1998
JP 2003-020975 A 1/2003
JP 2005-180217 A 7/2005
JP 2006-258036 A 9/2006
JP 2009-203884 A 9/2009
JP 2009-293436 A 12/2009

* cited by examiner

*1: Electric current detection section
*2: Fuel injection valve R
*3: Fuel injection valve L

*2: Fuel injection valve R
*3: Fuel injection valve L

*1: Electric current detection section
*4: Fuel injection valve R:Resistance value R1
*5: Fuel injection valve L:Resistance value R2

FUEL SUPPLY APPARATUS FOR INTERNAL COMBUSTION ENGINE

CROSS REFERENCE TO RELATED APPLICATIONS

This application is a National Stage of International Application No. PCT/JP2011/070037, filed Sep. 2, 2011, the contents of all of which are incorporated herein by reference in their entirety.

TECHNICAL FIELD

The present invention relates to a fuel supply apparatus for an internal combustion engine, and more particularly to a fuel supply apparatus for an internal combustion engine which includes a plurality of fuel injection valves for the same cylinder.

BACKGROUND ART

So far, for example, Patent Document 1 discloses a control apparatus for an internal combustion engine which includes a plurality of fuel injection valves for the same cylinder. More specifically, this conventional internal combustion engine includes, for each cylinder, one in-cylinder fuel injection valve capable of directly injecting fuel into a cylinder and one port fuel injection valve capable of injecting fuel into an intake port.

In the above described control apparatus for the internal combustion engine, the electric conduction to the in-cylinder fuel injection valve for each cylinder is controlled using a drive control circuit for in-cylinder injection that receives a fuel injection signal from an ECU. More specifically, the drive control circuit controls the electric conduction to a transistor for power feed control which is switching means that is provided separately with respect to the in-cylinder fuel injection valve for each cylinder, and an arrangement is thereby made such that the electric conduction to the in-cylinder fuel injection valve for each cylinder is controlled. Much the same is true on the port fuel injection valve.

That is to say, the above described conventional internal combustion engine includes, with respect to each cylinder, the in-cylinder fuel injection valve in which the electric conduction is controlled using the transistor for power feed control for in-cylinder injection, and the port fuel injection valve in which the electric conduction is controlled by a transistor for power feed control for port injection. On that basis, it can be said that, in the aforementioned control apparatus for the internal combustion engine, each fuel injection valve in each cylinder includes a detection circuit for disconnection failure.

Including the above described document, the applicant is aware of the following documents as related art of the present invention.

CITATION LIST

Patent Documents

Patent Document 1: Japanese Laid-open Patent Application Publication No. 2006-258036
Patent Document 2: Japanese Laid-open Patent Application Publication No. 10-252539
Patent Document 3: Japanese Laid-open Patent Application Publication No. 58-214634
Patent Document 4: Japanese Laid-open Patent Application Publication No. 2009-293436

Patent Document 5: Japanese Laid-open Patent Application Publication No. 2009-203884
Patent Document 6: Japanese Laid-open Patent Application Publication No. 2003-020975
Patent Document 7: Japanese Laid-open Patent Application Publication No. 2005-180217

SUMMARY OF INVENTION

Technical Problem

In a conventional internal combustion engine which includes a plurality of fuel injection valves for the same cylinder as described in above described Patent Document 1, there is a need to include a disconnection failure detection circuit for every fuel injection valve in order to identify a fuel injection valve at which disconnection has occurred when failure of the disconnection concerning a fuel injection valve has occurred in the same cylinder. That is to say, according to a single disconnection failure detection circuit, a fuel injection valve at which disconnection failure has occurred in the same cylinder can not be identified.

The present invention has been made to solve the problem as described above, and has its object to provide a fuel supply apparatus for an internal combustion engine, which can favorably identify, using a simple configuration, a fuel injection valve at which abnormality concerning electric conduction has occurred in the same cylinder, in a case of including an arrangement in which the electric conduction to a plurality of fuel injection valves that is installed in the same cylinder is controlled by a single drive circuit.

Solution to Problem

One aspect of the present invention, which is a fuel supply apparatus for an internal combustion engine including a plurality of fuel injection valves for a same cylinder, includes a drive circuit, an electric conduction line, electric current detection means, an electric resistance and abnormal fuel injection valve detection means.

The drive circuit is commonly provided with respect to the plurality of fuel injection valves for a same cylinder, and drives the plurality of fuel injection valves for a same cylinder on a basis of a command from outside. The electric conduction line includes a common section one end of which is connected to the drive circuit, and branch sections which are sections following another end of the common section that the electric conduction line branches off at and on which the plurality of fuel injection valves for a same cylinder are respectively installed. Through the electric conduction line that electric current supplied to the plurality of fuel injection valves flows. The electric current detection means detects electric current which flows through the common section of the electric conduction line. The electric resistance is inserted in the branch section of the electric conduction line with respect to each of one or more installation target fuel injection valves. Each value of the electric resistances is different from each other if the installation target fuel injection valves are more than one. The installation target fuel injection valves correspond to all or all-minus-one of the plurality of fuel injection valves for a same cylinder. The abnormal fuel injection valve detection means detects a fuel injection valve, at which an occurrence of abnormality concerning electric conduction is recognized, out of the plurality of fuel injection valves for a same cylinder, on a basis of a magnitude of an electric current value detected by the electric current detection means.

In a case in which the configuration according to the above described one aspect of the present invention is included, when abnormality concerning the electric conduction to any of fuel injection valves for the same cylinder has occurred, the electric current value that flows through the common section of the electric conduction line changes according to which of the fuel injection valves is the one at which abnormality concerning the electric conduction has occurred. Therefore, the one aspect of the present invention can favorably identify, using a simple configuration, a fuel injection valve at which abnormality concerning the electric conduction has occurred in the same cylinder, on the basis of the magnitude of the aforementioned electric current value detected by the electric current detection means.

Moreover, another aspect of the present invention, which is a fuel supply apparatus for an internal combustion engine including a plurality of fuel injection valves for a same cylinder, includes a drive circuit, an electric conduction line, electric current detection means and abnormal fuel injection valve detection means.

The drive circuit is commonly provided with respect to the plurality of fuel injection valves for a same cylinder, and drives the plurality of fuel injection valves for a same cylinder on a basis of a command from outside. The electric conduction line includes a common section one end of which is connected to the drive circuit, and branch sections which are sections following another end of the common section that the electric conduction line branches off at and on which the plurality of fuel injection valves for a same cylinder are respectively installed. Through the electric conduction line that electric current supplied to the plurality of fuel injection valves flows. The electric current detection means detects electric current which flows through the common section of the electric conduction line. Each of the plurality of fuel injection valves for a same cylinder is configured so that each of internal resistance values is different from each other. The abnormal fuel injection valve detection means detects a fuel injection valve, at which an occurrence of abnormality concerning electric conduction is recognized, out of the plurality of fuel injection valves for a same cylinder, on a basis of a magnitude of an electric current value detected by the electric current detection means.

In a case in which the configuration according to the above described another aspect of the present invention is included, when abnormality concerning the electric conduction to any of fuel injection valves for the same cylinder has occurred, the electric current value that flows through the common section of the electric conduction line also changes according to which of the fuel injection valves is the one at which abnormality concerning the electric conduction has occurred. Therefore, the another aspect of the present invention also can favorably identify, using a simple configuration, a fuel injection valve at which abnormality concerning the electric conduction has occurred in the same cylinder, on the basis of the magnitude of the aforementioned electric current value detected by the electric current detection means.

Further, the present invention may further include electric-conduction-time-in-abnormality control means that when an occurrence of the abnormality at a part of the plurality of fuel injection valves for a same cylinder is recognized by the abnormal fuel injection valve detection means, increases electric conduction time for one or more fuel injection valves at which an occurrence of the abnormality for the same cylinder is not recognized.

This increases the amount of fuel that is capable of being injected using a normal fuel injection valve that is left at an occurrence cylinder of the abnormality, even when the abnormality concerning the electric conduction to any of the fuel injection valves has occurred. As a result of this, the lack of fuel injection amount can be prevented at the occurrence cylinder of the abnormality, and a change in air-fuel ratio can therefore be prevented from occurring.

Further, the internal combustion engine in the present invention may include a plurality of cylinders. On that basis, the present invention may further include fuel-injection-amount-in-other-cylinder limit means that when an occurrence of the abnormality at a part of the plurality of fuel injection valves for a same cylinder is recognized by the abnormal fuel injection valve detection means, limits fuel injection amount for one or more cylinders other than a cylinder to which the fuel injection valve at which an occurrence of the abnormality is recognized belongs, in synchronization with a maximum injection amount of fuel that is capable of being injected by one or more remaining fuel injection valves for the same cylinder at which an occurrence of the abnormality is not recognized.

As a result of this, the lack of fuel injection amount can be prevented at a cylinder at which the abnormality concerning the electric conduction to any of the fuel injection valves has occurred, and a change in air-fuel ratio can therefore be prevented from occurring for every cylinder.

Further, the present invention may further include feed fuel pressure adjustment means that when an occurrence of the abnormality at a part of the plurality of fuel injection valves for a same cylinder is recognized by the abnormal fuel injection valve detection means, increases feed fuel pressure of fuel supplied to the plurality of fuel injection valves for each cylinder.

This increases the amount of fuel that is capable of being injected using a normal fuel injection valve that is left at an occurrence cylinder of the abnormality, even when the abnormality concerning the electric conduction to any of the fuel injection valves has occurred. As a result of this, the lack of fuel injection amount can be prevented at the occurrence cylinder of the abnormality, and a change in air-fuel ratio can therefore be prevented from occurring.

Further, the internal combustion engine in the present invention may include a plurality of cylinders. On that basis, the electric current detection means may include a non-contact electric current sensor as means for detecting electric current that flows through the common section of the electric conduction line of each of at least two of the plurality of cylinders included by the internal combustion engine.

This can identify, using a single non-contact electric current sensor, a fuel injection valve at which the abnormality concerning the electric conduction has occurred in any of cylinders, and the cost can therefore be more reduced.

DESCRIPTION OF EMBODIMENTS

First Embodiment

System Configuration of Internal Combustion Engine

Figure 1:
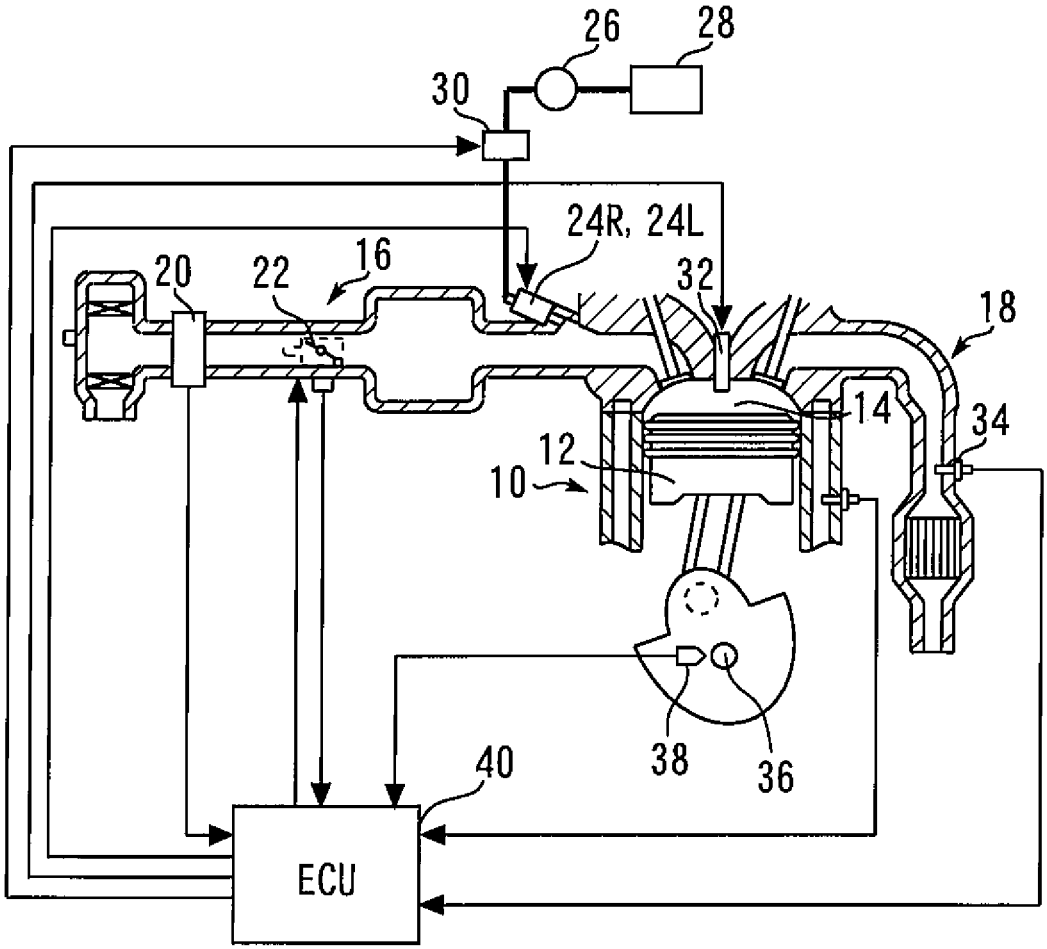
FIG. 1 is a diagram for explaining a system configuration of an internal combustion engine on which a fuel supply apparatus according to a first embodiment of the present invention is mounted.

FIG. 1 is a diagram for explaining a system configuration of an internal combustion engine 10 on which a fuel supply apparatus according to a first embodiment of the present invention is mounted. The system shown in FIG. 1 includes an internal combustion engine 10. Although the number of cylinders and the cylinder arrangement of the internal combustion engine 10 in the present invention are not specifically limited, it is assumed that, as one example, the internal combustion engine 10 in the present embodiment is an in-line 4-cylinder engine having four cylinders No. 1 to No. 4.

There is provided a piston 12 in each cylinder of the internal combustion engine 10. A combustion chamber 14 is formed at the top side of the piston 12 in each cylinder. An intake passage 16 and exhaust passage 18 are in communication with the combustion chamber 14. An airflow meter 20, which outputs a signal in accordance with the flow rate of air sucked into the intake passage 16 is provided in the vicinity of an inlet of the intake passage 16. An electronically controlled throttle valve 22 is provided downstream of the air flow meter 20.

In the intake passage 16 after branching off toward each cylinder (intake manifold section), electromagnetic fuel injection valves 24R and 24L inside which the respective electromagnetic coils (not shown) are included are installed to inject fuel into the respective intake ports. That is to say, the internal combustion engine 10 in the present embodiment includes two fuel injection valves 24R and 24L for every cylinder. It is assumed in the present embodiment that internal resistance values of the electromagnetic coils which these fuel injection valves 24R and 24L include are identical. Fuel in a fuel tank 28 is supplied to the fuel injection valves 24R and 24L by a fuel pump (feed pump) 26. The system of the present embodiment includes a fuel pressure regulator 30 to make variable the pressure of fuel supplied to the fuel injection valves 24R and 24L (hereinafter, referred to as the "feed fuel pressure").

Moreover, an ignition plug 32 for igniting air-fuel mixture in the combustion chamber 14 is provided in each cylinder. Further, an air fuel ratio sensor 34 for detecting the air-fuel ratio of exhaust gas discharged from inside each cylinder is disposed in the exhaust passage 18. Furthermore, a crank angle sensor 38 for detecting the rotational angle (crank angle) of a crankshaft 36 of the internal combustion engine 10 and an engine speed is installed in the vicinity of the crankshaft 36.

Moreover, the system shown in FIG. 1 includes an ECU (Electronic Control Unit) 40. There are electrically connected to an input section of the ECU 40, various sensors for detecting the operational state of the internal combustion engine 10, such as the air flow meter 20, the air-fuel ratio sensor 34, the crank angle sensor 38 and the like that are described above. In addition, there are electrically connected to an output section of the ECU 40, various actuators for controlling the operation of the internal combustion engine 10, such as the throttle valve 22, the fuel injection valves 24R and 24L, the fuel pressure regulator 30, the ignition plug 32 and the like that are described above. The ECU 40 controls the operational state of the internal combustion engine 10 by actuating the various actuators on the basis of the outputs of the various sensors and predetermined programs.

[Configuration of Fuel Injection Control Unit]

Figure 2:
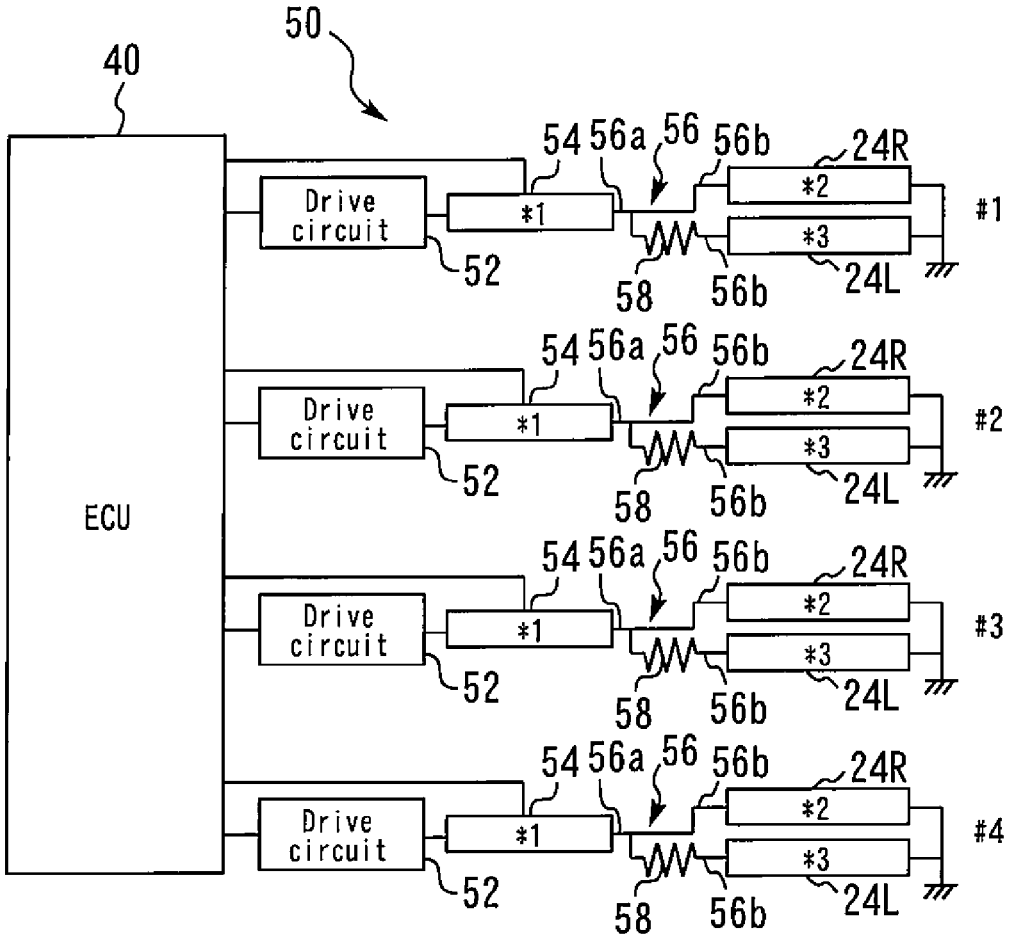
FIG. 2 is a block diagram that schematically represents a configuration of a fuel injection control unit in the fuel supply apparatus of the internal combustion engine according to the first embodiment of the present invention.

FIG. 2 is a block diagram that schematically represents a configuration of a fuel injection control unit 50 in the fuel supply apparatus of the internal combustion engine according to the first embodiment of the present invention.

As shown in FIG. 2, the fuel injection control unit 50 includes one drive circuit 52 and one electric current detection section 54 for every cylinder. The drive circuit 52 controls the electric conduction to two fuel injection valves 24R and 24L for the same cylinder. The drive circuit 52 is electrically connected with ECU 40, and electrically connected to the two fuel injection valves 24R and 24L for the same cylinder through an electric conduction line 56. Inside the drive circuit 52, electronic parts, such as a transistor (not shown) as switching means, are incorporated. The drive circuit 52 is configured so that when receiving a command (fuel injection signal) from the ECU 40, the drive electric voltage (here, battery voltage (+B) as one example) is applied to each of the fuel injection valves 24R and 24L through the electric conduction line 56 by forcing the aforementioned transistor into conduction. The electromagnetic coils included in the fuel injection valves 24R and 24L generate electromagnetic forces as a result of the flow of drive electric current in response to application of the aforementioned drive electric voltage. As a result of this, the fuel injection valves 24R and 24L open, and fuel is injected to each intake port.

As described above, the fuel injection control unit 50 of the present embodiment has a single drive circuit 52 with respect to two fuel injection valves 24R and 24L that are provided for the same cylinder, and controls the operation of the fuel injection valves 24R and 24L using the drive circuit 52 (more specifically, single switching means (the aforementioned transistor)) that controls the electric conduction.

In addition, as shown in FIG. 2, the electric conduction line 56 includes a common section 56*a*, one end of which is connected to the drive circuit 52, and two branch sections 56*b* which are two sections following the other end of the common section 56*a* that the electric conduction line 56 branches off at and on which two fuel injection valves 24R and 24L for the same cylinder are respectively installed. Further, the aforementioned electric current detection section 54 is provided at the common section 56*a* of the electric conduction line 56 in order to detect an electric current that flows through the section. The electric current detection section 54 incorporates an electric resistance (not shown), the resistance value of which is small and which has high power durability. The ECU 40 is configured so as to be able to detect the value of electric current flowing through the common section 56*a* of the electric conduction line 56 by detecting the voltage between both ends of the electric resistance included in the electric current detection section 54.

Furthermore, as shown in FIG. 2, in the branch section 56*b* on one side (here, the fuel injection valve 24L side as one example) of two fuel injection valves 24R and 24L in each cylinder, a small electric resistance 58 (for example, 1Ω) is inserted in series with (the electromagnetic coil of) the fuel injection valve 24L.

[Detection Method of Disconnection Failure of Fuel Injection Valve (Identification Method of Fuel Injection Valve at which Disconnection Failure has Occurred)]

In a case in which a plurality of (for example, two) fuel injection valves are included for each cylinder, if these fuel injection valves are activated on the basis of a single electric conduction timing, installing one drive circuit for each cylinder as in the configuration described so far with reference to FIGS. 1 and 2 can constitute a fuel injection control unit while keeping cost low. On the other hand, a circuit to detect disconnection failure of the fuel injection valves is generally included in the fuel injection control unit. Such circuit is to detect the presence or absence of disconnection failure of the fuel injection valves on the basis of the presence or absence of the electric conduction to the fuel injection valves.

However, in the aforementioned case of a configuration that includes a plurality of fuel injection valves for each cylinder and one drive circuit for each cylinder, if no special consideration as in a detection method of the present embodiment described later is made, it is impossible to determine that, using one electric current detection section, disconnection failure has occurred at which of the fuel injection valves. More specifically, a fuel injection valve of port injection type is generally driven by the battery voltage (+B), and the resistance value of the electromagnetic coil of each fuel injection valve is about 12Ω. Because of this, when the electric conduction to two fuel injection valves for the same cylinder is normal, about one ampere of electric current flows through each fuel injection valve. However, if the electric current is detected at a common section of an electric conduction line in such configuration, the detected value of electric current indicates the same value of nearly one ampere even when disconnection failure has occurred at either of the two fuel injection valves. It is therefore impossible to determine a fuel injection valve at which disconnection failure has occurred. As a result of this, it is required to provide two types of electric current detection sections per one cylinder, and there is a problem in cost.

Accordingly, in the present embodiment, as described above, the electric resistance 58 is provided in series on the branch section 56*b* of the electric conduction line 56 on the one side (the fuel injection valve 24L side in FIG. 2) of two fuel injection valves 24R and 24L that are disposed in each cylinder. Further, using the electric current detection section 54, it is determined that disconnection failure has occurred at which of the two fuel injection valves 24R and 24L for the same cylinder, on the basis of the magnitude of the electric current value at the common section 56*a* of the electric conduction line 56.

Figure 3:
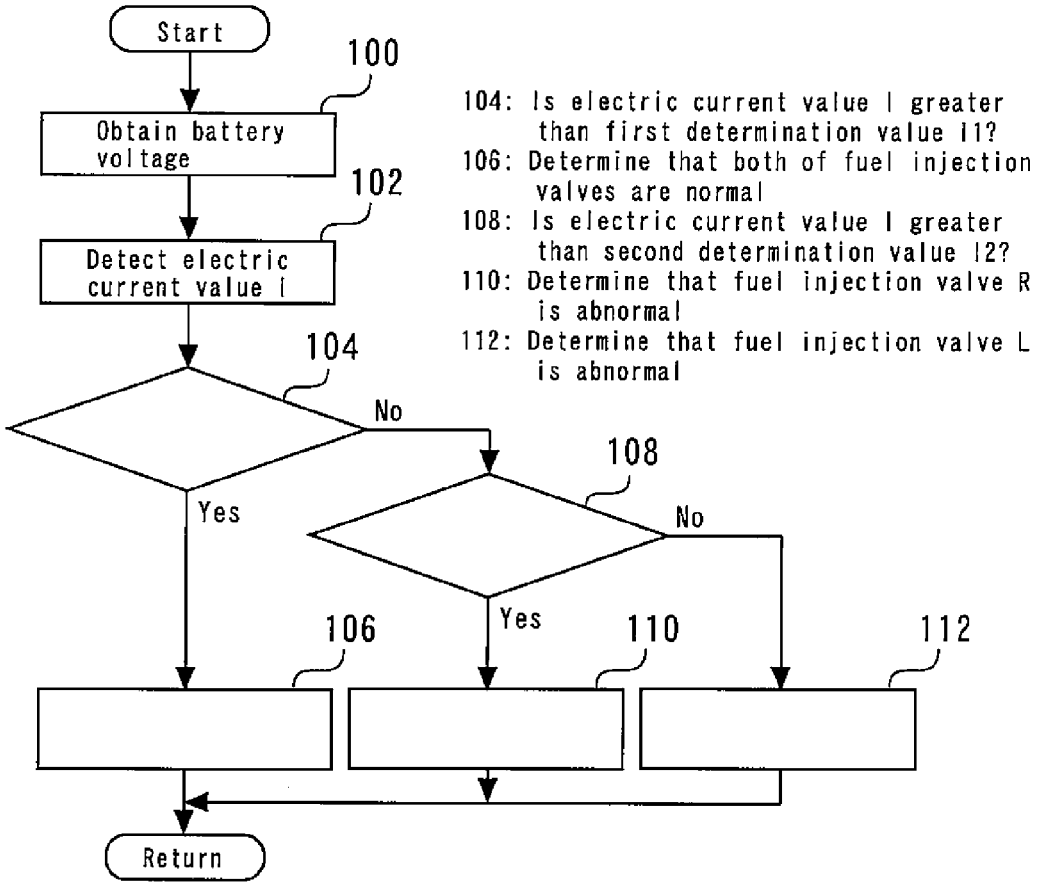
FIG. 3 is a flowchart of a disconnection failure detection routine for fuel injection valves that is executed in the first embodiment of the present invention.

FIG. 3 is a flowchart showing a disconnection failure detection routine for fuel injection valves that is executed by the ECU 40 according to the first embodiment of the present invention. The present routine is supposed to be started whenever the electric conduction timing of the fuel injection valves 24R and 24L in each cylinder arrives.

According to the routine shown in FIG. 3, first, the present battery voltage value (power-supply voltage value) is obtained (step 100). Next, the value I of the electric current that flows through the common section 56*a* of the electric conduction line 56 is detected using the electric current detection section 54 (step 102).

Next, it is determined whether or not the electric current value I detected in step 102 is higher than a predetermined first determination value I1 (step 104). The electric current value I when the electric conduction to two fuel injection valves 24R and 24L for the same cylinder is normally performed becomes a value nearly twice as much as that when disconnection failure has occurred at either one of the fuel injection valves. For example, when the resistance value of the electromagnetic coil of each of the fuel injection valves 24R and 24L is 12Ω and the resistance value of the electric resistance 58 is 1Ω, the combined resistance becomes 6.24Ω. Therefore, the electric current value I when disconnection failure has not occurred at any of the fuel injection valves 24R and 24L becomes nearly 1.92 A provided that the battery voltage is 12V. In contrast, the electric current value I when disconnection failure has occurred at the fuel injection valve 24R becomes nearly 0.92 A provided that the battery voltage is 12V, and the electric current value I when disconnection failure has occurred at the fuel injection valve 24L becomes nearly 1 A if the battery voltage is 12V. However, the electric current value I in each case may change in accordance with a change in the battery voltage value during operation of the internal combustion engine 10. Specifically, the electric current value I becomes larger as the battery voltage value is larger. With understanding such tendency of the electric current value I in advance, the first determination value I1 in present step 104 is set beforehand as a value (for example, 1.5 A) which is able to judge whether the electric conduction to two fuel injection valves 24R and 24L for the same cylinder is normal or disconnection failure has occurred at either one of the fuel injection valves.

If it is determined in aforementioned step 104 that the electric current value I is higher than the aforementioned first determination value I1, it is determined that the electric conduction to the two fuel injection valves 24R and 24L for the cylinder at which the determination is being executed in the present processing cycle is normal (step 106).

If, on the other hand, the aforementioned determination of step 104 is not established, it is then determined whether or not the electric current value I is lower than a predetermined second determination value I2 (step 108). The second determination value I2 in present step 108 is set in advance so as to be a value intermediate between the electric current value I when disconnection failure has occurred at the fuel injection valve 24R and the electric current value I when disconnection failure has occurred at the fuel injection valve 24L, in order to determine that the disconnection failure has occurred at which of the two fuel injection valves 24R and 24L for the same cylinder. Moreover, the second determination value I2 is set so as to be a larger value as the battery voltage is higher. For example, in a case exemplified as described above, the electric current I when disconnection failure has occurred at the fuel injection valve 24R becomes nearly 0.92 A provided that the battery voltage is 12V, while the electric current I when disconnection failure has occurred at the fuel injection valve 24L becomes nearly 1 A provided that the battery voltage is 12V. Accordingly, in this case, the aforementioned second determination value I2 is set to, for example, 0.96 A as a value that can make the distinction between 0.92 A and 1 A. That is to say, in present step 108, the second determination value I2 that is referred to on the basis of the present battery voltage value is compared with the present electric current value I. According to such manner, the electric current value I that depends on the difference in the fuel injection valve at which disconnection failure has occurred can be evaluated accurately regardless of a change in the battery voltage value during operation of the internal combustion engine 10.

If it is determined in step 108 that the electric current value I is lower than the aforementioned second determination value I2, it is determined that disconnection failure has occurred at the fuel injection valve 24R (step 110). If, on the other hand, it is determined in step 108 that the electric current value I is greater than or equal to the aforementioned second determination value I2, that is, it can be judged that the electric current value I is a value between the second determination value I2 and the first determination value I1, it is determined that disconnection failure has occurred at the fuel injection valve 24L (step 112).

As described above, in the fuel injection control unit 50 of the present embodiment, the electric resistance 58 is inserted in series on the branch section 56*b* of the electric conduction line 56 on one side (in FIG. 2, the fuel injection valve 24L side) of two fuel injection valves 24R and 24L for each cylinder, and thereby, the resistance values on two branch sections 56*b* including the electromagnetic coils of the fuel injection valves 24R and 24L are differentiated from each other. On that basis, when disconnection failure has occurred, the routine shown in FIG. 3 described so far can easily determine that the disconnection failure has occurred at which of the fuel injection valves, on the basis of a change in the electric current value I of the common section 56*a* of the electric conduction line 56. Although not illustrated in FIG. 3, when the electric current value I is not detected (when it is zero), it can be determined that disconnection failure has occurred at both of the fuel injection valves 24R and 24L.

As described above, the system of the present embodiment in which the operation of two fuel injection valves 24R and 24L for the same cylinder is controlled using the single drive circuit 52 can identify, using one electric current detection section 54, a fuel injection valve at which disconnection failure has occurred, by use of a simple configuration in which one of the branch sections 56*b* includes the small electric resistance 56 that can discriminate the difference in the value I of the electric current flowing through the common section 56*a*, according to whether disconnection failure has occurred at the fuel injection valve 24R or 24L.

[Control when Disconnection Failure has Occurred at One of Fuel Injection Valves]

Figure 4:
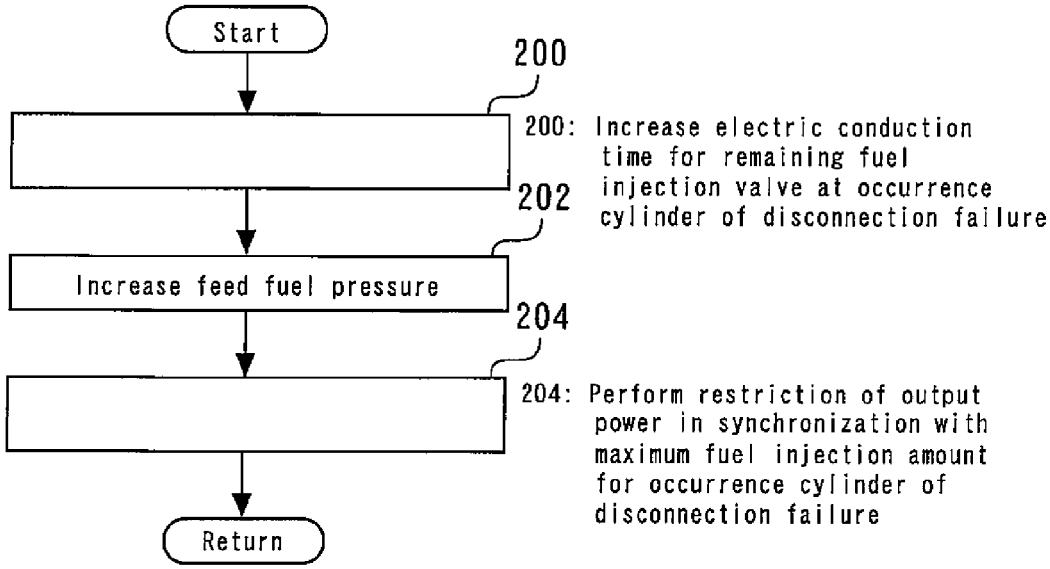
FIG. 4 is a flowchart of a control routine that is executed in the first embodiment of the present invention.

FIG. 4 is a flowchart of a control routine executed by the ECU 40 at the time of occurrence of disconnection failure according to the first embodiment of the present invention. The present routine is supposed to be started when the processing of step 110 or 112 in the aforementioned routine in FIG. 3 (that is, when disconnection failure has been detected at either one of the fuel injection valves 24R and 24L) has been executed.

In the routine shown in FIG. 4, first, the processing to increase the electric conduction time for the fuel injection valve 24R or 24L at which an occurrence of disconnection failure is not recognized is executed in a cylinder to which the fuel injection valve 24R or 24L where the disconnection failure has occurred belongs (step 200). More specifically, in a situation in which one of the fuel injection valves 24R and 24L can not be used, the electric conduction time for the fuel injection valve 24R or 24 L which is normal is increased in such a way as to ensure a fuel injection amount that satisfies the present target air-fuel ratio.

Next, by controlling the fuel pressure regulator 30, the feed fuel pressure that is supplied to the fuel injection valves 24R and 24L for each cylinder is increased (step 202). When including a configuration that can change a fuel pressure applied to a normal fuel injection valve 24R or 24L that is left at a cylinder with occurrence of disconnection failure, separately with a fuel pressure applied to the fuel injection valves 24R and 24L at the other cylinders, only the fuel pressure with respect to the occurrence cylinder of the disconnection failure may be increased.

Next, a fuel injection amount for the remaining cylinders at which disconnection failure has not occurred is limited in synchronization with the maximum injection amount of fuel capable of being injected by a normal fuel injection valve 24R or 24L that is left at a cylinder at which disconnection failure has occurred, in a state in which feed fuel pressure has been increased by the aforementioned processing step 202 (step 204).

According to the routine shown in FIG. 4 described so far, in a cylinder to which the fuel injection valve 24R or 24L where disconnection failure has occurred, the electric conduction time of the fuel injection valve 24R or 24L at which the occurrence of the disconnection failure is not recognized is increased so that a fuel injection amount that satisfies the present target air-fuel ratio can be ensured. Even when disconnection failure has occurred, this can maintain the air-fuel ratio at an occurrence cylinder of the disconnection failure at the same value as that before the occurrence of the disconnection failure. A change in air-fuel ratio can therefore be prevented from occurring for every cylinder. As a result, exhaust emission can be prevented from being deteriorated.

Moreover, according to the above described routine, a fuel injection amount for the remaining cylinders at which disconnection failure has not occurred is limited in synchronization with the maximum injection amount of fuel capable of being injected by a normal fuel injection valve 24R or 24L that is left at a cylinder at which disconnection failure has occurred. That is to say, the output power of the internal combustion engine 10 is restricted in synchronization with the aforementioned maximum fuel injection amount. This can prevent the lack of fuel injection amount at an occurrence cylinder of disconnection failure, and therefore, a change in air-fuel ratio can be prevented from occurring for every cylinder. Also according to such control, exhaust emission can be prevented from being deteriorated.

Further, according to the above described routine, when disconnection failure is detected, the feel fuel pressure that is supplied to the fuel injection valves 24R and 24L for each cylinder is increased by controlling the fuel pressure regulator 30. This increases the amount of fuel that is capable of being injected using a normal fuel injection valve 24L or 24R that is left at an occurrence cylinder of disconnection failure. As a result of this, the lack of fuel injection amount can be prevented at the occurrence cylinder of the disconnection failure, and a change in air-fuel ratio can therefore be prevented from occurring for every cylinder. Such control also can prevent exhaust emission from being deteriorated. In addition, the aforementioned restriction of the output power can be eased.

In the first embodiment, which has been described above, the electric current detection section 54 is included, on the common section 56*a* of the electric conduction line 56 for each cylinder in the fuel injection control unit 50. The electric current detection means in the present invention, however, is not limited to the aforementioned configuration, and may, for example, be the one shown in FIG. 5 described later.

Figure 5:
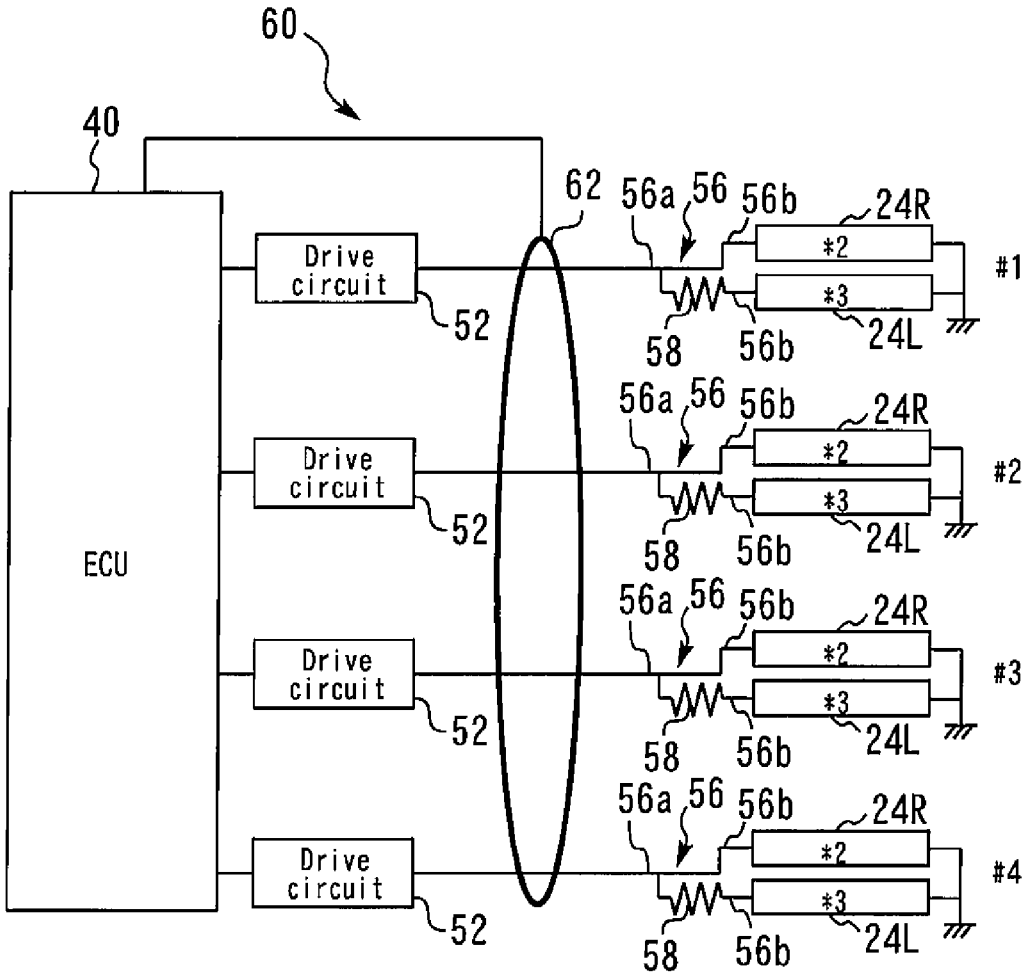
FIG. 5 is a block diagram that schematically represents a configuration of a fuel injection control unit according to a modified embodiment with respect to the first embodiment of the present invention.

FIG. 5 is a block diagram that schematically represents a configuration of a fuel injection control unit 60 according to a modified embodiment with respect to the first embodiment of the present invention. It is noted that in FIG. 5, the same element as that shown in above described FIG. 2 is given the same reference character thereby omitting or simplifying the description thereof.

In the fuel injection control unit 60 shown in FIG. 5, a non-contact electric current sensor 62 using a hall element is included instead of the aforementioned electric current detection section 54. This electric current sensor 62 is a sensor that is capable of detecting an electric current value by converting, into an electric signal, magnetic field generated when electric current flows through the electric conduction line 56. The configuration shown in FIG. 5 detects the electric current flowing through the common section 56*a* of the electric conduction line 56 for all cylinders, using the single electric current sensor 62. In the in-line four-cylinder internal combustion engine 10, the electric conduction times for the fuel injection valve 24R and 24L for each cylinder are not overlapped with each other. Therefore, the configuration as described above can determine that the electric current value I at a given time pertains to which of the cylinders, by comparing the electric current value I detected by the electric current sensor 62 with a drive signal (fuel injection signal) to each cylinder from the ECU 40. With the processing of the above described routine shown in FIG. 3 being applied to the configuration shown in FIG. 5 that includes such electric current sensor 62, the fuel injection valve 24R or 24L at which disconnection failure has occurred at any cylinder can be identified by use of one electric current sensor 62, and the cost can therefore be more reduced. Furthermore, with the processing of the above described routine shown in FIG. 4 being applied to the aforementioned configuration, a change in air-fuel ratio for every cylinder can be prevented as already described when disconnection failure has occurred at one of the fuel injection valves 24R and 24L. It is noted that if the electric conduction times are arranged not to be overlapped, the non-contact electric current sensor 62 can be applied also to an internal combustion engine having another cylinder arrangement as well as an in-line four-cylinder engine like the internal combustion engine 10.

Moreover, in the first embodiment, which has been described above, the small electric resistance 58 (for example, 1Ω) is inserted in series with (the electromagnetic coil of) the fuel injection valve 24L, in the branch section 56*b* on one side (in FIG. 2, the fuel injection valve 24L side) of two fuel injection valves 24R and 24L for each cylinder. The installation target fuel injection valve of the electric resistance in the present invention, however, is not limited to only one of the two fuel injection valves 24R and 24L as described above. More specifically, when two fuel injection valves are included for the same cylinder, an electric resistance the value of which is different from each other may, for example, be included, as needed, for each fuel injection valve. In addition, the electric resistance in the present invention may be the one that is provided inside a fuel injection valve, provided the branch section includes it in series with an electric coil included in the fuel injection valve.

Furthermore, in the above described first embodiment, explanation has been made by taking an example of the configuration in which two fuel injection valves 24R and 24L are included for each cylinder. The number of fuel injection valves included for the same cylinder in the present invention is however not limited to two but may be more than two. Even when the number of fuel injection valves included for the same cylinder is more than two, the present invention can judge the number of fuel injection valves for the same cylinder at which disconnection failure has occurred, on the basis of the magnitude of the aforementioned electric current value I. In further addition to that, for example, when the number of fuel injection valves included for the same cylinder is three, the number of the installation target fuel injection valves concerning the electric resistances in the present invention becomes two or three.

It is noted that in the first embodiment, which has been described above, the fuel injection valves 24R and 24L correspond to the "plurality of fuel injection valves" according to one aspect of the present invention; the fuel injection valve 24L corresponds to the "installation target fuel injection valve" according to one aspect of the present invention; and the electric resistance 58 corresponds to the "electric resistance" according to one aspect of the present invention. In addition, the ECU 40 executes the above described processing of step 102, whereby the "electric current detection means" according to one aspect of the present invention is realized; and the ECU 40 executes the above described processing of a series of steps 104 to 112, whereby the "abnormal fuel injection valve detection means" according to one aspect of the present invention is realized.

Moreover, in the first embodiment, which has been described above, the ECU 40 executes the above described processing of step 200, whereby the "electric-conduction-time-in-abnormality control means" according to the present invention is realized. Further, the ECU 40 executes the above described processing of step 204, whereby the "fuel-injection-amount-in-other-cylinder limit means" according to the present invention is realized. Furthermore, the ECU 40 executes the above described processing of step 202, whereby the "feed fuel pressure adjustment means" according to the present invention is realized.

Second Embodiment

Next, a second embodiment of the present invention will be described with reference to FIG. 6.

Figure 6:
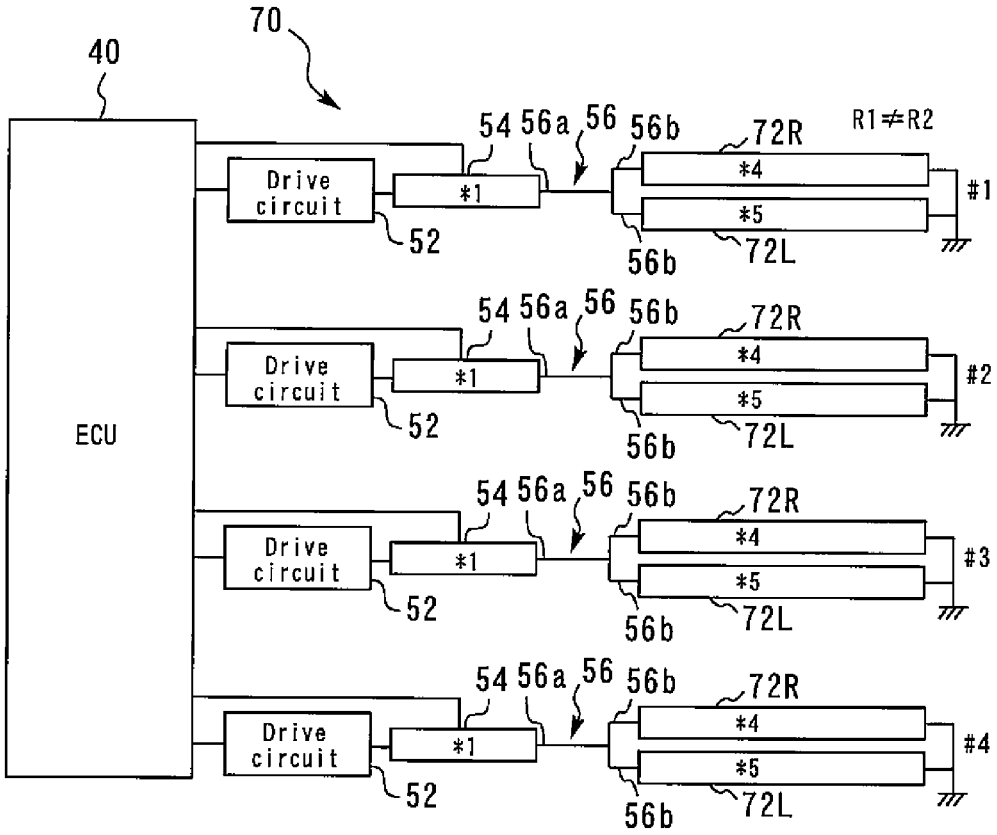
FIG. 6 is a block diagram that schematically represents a configuration of a fuel injection control unit according to a second embodiment of the present invention.

FIG. 6 is a block diagram that schematically represents a configuration of a fuel injection control unit 70 according to the second embodiment of the present invention. It is noted that in FIG. 6, the same element as that shown in above described FIG. 2 is given the same reference character thereby omitting or simplifying the description thereof.

In the fuel injection control unit 50 of the above described first embodiment (see FIG. 2), the electric resistance 58 is included in series with the fuel injection valve 24L, on the branch section 56*b* of the electric conduction line 56 on the fuel injection valve 24L side in each cylinder. In contrast to this, in a fuel injection control unit 70 of the present embodiment, as shown in FIG. 6, such electric resistance 58 is not included on the branch section 56*b* of the electric conduction line 56, and alternatively, a resistance value R1 of an electromagnetic coil of one fuel injection valve 72R is set to a value mutually different from a resistance value R2 of an electromagnetic coil of the other fuel injection valve 72L. More specifically, the resistance value R1 and the resistance value R2 are set so as to differ to a level that can discriminate a difference in the electric current I flowing through the common section 56*a*, according to whether disconnection failure has occurred at the fuel injection valve 24R or 24L. Such setting can be achieved by making a difference in, for example, the number of turns in the electromagnetic coils.

Also by adopting the configuration of the present embodiment described above, the resistance values at two branch sections 56*b* for each of the fuel injection valves 72R and 72L can be differentiated from each other, as in the configuration of the above described first embodiment. Further, also in the present embodiment, the ECU 40 executes the processing of the above described routine shown in FIG. 3, whereby a fuel injection valve at which disconnection failure has occurred can be easily identified on the basis of a change in the electric current value I of the common section 56*a* of the electric conduction line 56, when the disconnection failure has occurred.

Furthermore, also in the present embodiment, the ECU 40 executes the processing of the above described routine shown in FIG. 4, whereby the advantageous effects explained in the aforementioned first embodiment can be obtained when disconnection failure is detected. In addition, by modifying the configuration of the fuel injection control unit 70 of the present embodiment, the non-contact electric current sensor 62 may be included instead of the electric current detection section 54, as already described with reference to FIG. 5.

It is noted that in the second embodiment, which has been described above, the fuel injection valves 72R and 72L correspond to the "plurality of fuel injection valves" according to another aspect of the present invention. In addition, the ECU 40 executes the above described processing of step 102, whereby the "electric current detection means" according to another aspect of the present invention is realized; and the ECU 40 executes the above described processing of a series of steps 104 to 112, whereby the "abnormal fuel injection valve detection means" according to another aspect of the present invention is realized.

Incidentally, in the first and second embodiments, which have been described above, the fuel injection valve 24R or 24L at which disconnection failure has occurred is identified on the basis of the electric current value I flowing through the common section 56*a* of the electric conduction line 56, in a case of including the plurality of fuel injection valves 24R and 24L controlled by the same drive circuit 52 for the same cylinder and of further including a configuration in which the respective resistance values at each branch section 56*b* of the electric conduction line 56 after branching off toward each of the fuel injection valves 24R and 24L are different from each other. However, a mode of abnormality concerning the electric conduction to fuel injection valves as a target for determination in the present invention is not necessarily limited to disconnection failure provided that it can be judged on the basis of a change in the magnitude of the aforementioned electric current value I, and may, for example, be degradation of an electromagnetic oil included in the fuel injection valve.

DESCRIPTION OF SYMBOLS

10 internal combustion engine
12 piston
14 combustion chamber
16 intake passage
18 exhaust passage
20 air flow meter
22 throttle valve
24L, 24R, 72L, 72R fuel injection valve
26 fuel pump
28 fuel tank
30 fuel pressure regulator
32 ignition plug
34 air-fuel ratio sensor
40 ECU (Electronic Control Unit)
50, 60, 70 fuel injection control unit
52 drive circuit
54 electric current detection section
56 electric conduction line
56*a* common section of electric conduction line
56*b* branch section of electric conduction line
58 electric resistance
62 electric current sensor

The invention claimed is:

1. A fuel supply apparatus for an internal combustion engine including a plurality of fuel injection valves for a same cylinder, the apparatus comprising:

a drive circuit that is commonly provided with respect to the plurality of fuel injection valves for a same cylinder, and drives the plurality of fuel injection valves for a same cylinder on a basis of a command from outside;

an electric conduction line that electric current supplied to the plurality of fuel injection valves flows through, the electric conduction line including a common section one end of which is connected to the drive circuit, the electric conduction line including branch sections which are sections following another end of the common section that the electric conduction line branches off at and on which the plurality of fuel injection valves for a same cylinder are respectively installed;

an electric current detection unit for detecting electric current which flows through the common section of the electric conduction line;

an electric resistance which is inserted in the branch section of the electric conduction line with respect to each of one or more installation target fuel injection valves, each value of the electric resistances being different from each other if the installation target fuel injection valves are more than one, wherein the installation target fuel injection valves correspond to all or all-minus-one of the plurality of fuel injection valves for a same cylinder; and an abnormal fuel injection valve detection unit for detecting a fuel injection valve, at which an occurrence of abnormality concerning electric conduction is recognized, out of the plurality of fuel injection valves for a same cylinder, on a basis of a magnitude of an electric current value detected by the electric current detection unit.

2. A fuel supply apparatus for an internal combustion engine including a plurality of fuel injection valves for a same cylinder, the apparatus comprising:

a drive circuit that is commonly provided with respect to the plurality of fuel injection valves for a same cylinder, and drives the plurality of fuel injection valves for a same cylinder on a basis of a command from outside;

an electric conduction line that electric current supplied to the plurality of fuel injection valves flows through, the electric conduction line including a common section one end of which is connected to the drive circuit, the electric conduction line including branch sections which are sections following another end of the common section that the electric conduction line branches off at and on which the plurality of fuel injection valves for a same cylinder are respectively installed; and an electric current detection unit for detecting electric current which flows through the common section of the electric conduction line, wherein each of the plurality of fuel injection valves for a same cylinder is configured so that each of internal resistance values is different from each other, and wherein the fuel supply apparatus further comprises an abnormal fuel injection valve detection unit for detecting a fuel injection valve, at which an occurrence of abnormality concerning electric conduction is recognized, out of the plurality of fuel injection valves for a same cylinder, on a basis of a magnitude of an electric current value detected by the electric current detection unit.

3. The fuel supply apparatus for the internal combustion engine according to claim 1, further comprising:

an electric-conduction-time-in-abnormality control unit that when an occurrence of the abnormality at a part of the plurality of fuel injection valves for a same cylinder is recognized by the abnormal fuel injection valve detection unit, increases electric conduction time for one or more fuel injection valves at which an occurrence of the abnormality for the same cylinder is not recognized.

4. The fuel supply apparatus for the internal combustion engine according to claim 1, wherein the internal combustion engine includes a plurality of cylinders, and wherein the fuel supply apparatus further comprises a fuel-injection-amount-in-other-cylinder limit unit that when an occurrence of the abnormality at a part of the plurality of fuel injection valves for a same cylinder is recognized by the abnormal fuel injection valve detection unit, limits fuel injection amount for one or more cylinders other than a cylinder to which the fuel injection valve at which an occurrence of the abnormality is recognized belongs, in synchronization with a maximum injection amount of fuel that is capable of being injected by one or more remaining fuel injection valves for the same cylinder at which an occurrence of the abnormality is not recognized.

5. The fuel supply apparatus for the internal combustion engine according to claim 1, further comprising:

a feed fuel pressure adjustment unit that when an occurrence of the abnormality at a part of the plurality of fuel injection valves for a same cylinder is recognized by the abnormal fuel injection valve detection unit, increases feed fuel pressure of fuel supplied to the plurality of fuel injection valves for each cylinder.

6. The fuel supply apparatus for the internal combustion engine according to claim 1, wherein the internal combustion engine includes a plurality of cylinders, and wherein the electric current detection unit includes a non-contact electric current sensor as a device for detecting electric current that flows through the common section of the electric conduction line of each of at least two of the plurality of cylinders included by the internal combustion engine.

7. The fuel supply apparatus for the internal combustion engine according to claim 2, further comprising:

an electric-conduction-time-in-abnormality control unit that when an occurrence of the abnormality at a part of the plurality of fuel injection valves for a same cylinder is recognized by the abnormal fuel injection valve detection unit, increases electric conduction time for one or more fuel injection valves at which an occurrence of the abnormality for the same cylinder is not recognized.

8. The fuel supply apparatus for the internal combustion engine according to claim 2, wherein the internal combustion engine includes a plurality of cylinders, and wherein the fuel supply apparatus further comprises a fuel-injection-amount-in-other-cylinder limit unit that when an occurrence of the abnormality at a part of the plurality of fuel injection valves for a same cylinder is recognized by the abnormal fuel injection valve detection unit, limits fuel injection amount for one or more cylinders other than a cylinder to which the fuel injection valve at which an occurrence of the abnormality is recognized belongs, in synchronization with a maximum injection amount of fuel that is capable of being injected by one or more remaining fuel injection valves for the same cylinder at which an occurrence of the abnormality is not recognized.

9. The fuel supply apparatus for the internal combustion engine according to claim 2, further comprising:

a feed fuel pressure adjustment unit that when an occurrence of the abnormality at a part of the plurality of fuel injection valves for a same cylinder is recognized by the abnormal fuel injection valve detection unit, increases feed fuel pressure of fuel supplied to the plurality of fuel injection valves for each cylinder.

10. The fuel supply apparatus for the internal combustion engine according to claim 2, wherein the internal combustion engine includes a plurality of cylinders, and wherein the electric current detection unit includes a non-contact electric current sensor as a device for detecting electric current that flows through the common section of the electric conduction line of each of at least two of the plurality of cylinders included by the internal combustion engine.

* * * * *